US007802748B2

(12) United States Patent
De Matteis et al.

(10) Patent No.: US 7,802,748 B2
(45) Date of Patent: Sep. 28, 2010

(54) CORE FEEDING METHOD IN A REWINDING MACHINE FOR MAKING LOGS OF SHEET MATERIAL

(75) Inventors: Alessandro De Matteis, Lucca (IT); Sergio Landucci, Ponte a Moriano (IT)

(73) Assignee: Macchine Trasformazione Carta (IT)

( * ) Notice: Subject to any disclaimer, the term of this patent is extended or adjusted under 35 U.S.C. 154(b) by 979 days.

(21) Appl. No.: 11/359,549

(22) Filed: Feb. 21, 2006

(65) Prior Publication Data

US 2006/0138272 A1 Jun. 29, 2006

(51) Int. Cl.
*B65H 35/08* (2006.01)

(52) U.S. Cl. ..... 242/526.1; 242/532.3; 242/533.1; 242/542.2

(58) Field of Classification Search ..... 242/542.1, 242/542.2, 542.3, 542.4, 533.1, 532.3
See application file for complete search history.

(56) References Cited

U.S. PATENT DOCUMENTS 5,639,046 A * 6/1997 Biagiotti ..... 242/541.2
5,769,352 A * 6/1998 Biagiotti ..... 242/521
5,839,680 A * 11/1998 Biagiotti ..... 242/160.1
5,979,818 A * 11/1999 Perini et al. ..... 242/521
6,000,657 A * 12/1999 Butterworth ..... 242/533.2
6,050,519 A * 4/2000 Biagiotti ..... 242/526.1
6,648,266 B1 * 11/2003 Biagiotti et al. ..... 242/521
6,871,814 B2 * 3/2005 Daul et al. ..... 242/521
7,318,562 B2 * 1/2008 Biagiotti et al. ..... 242/521

* cited by examiner

*Primary Examiner*—John Q. Nguyen
*Assistant Examiner*—Juan J Campos
(74) *Attorney, Agent, or Firm*—The Bilicki Law Firm, PC; Byron A. Bilicki; Rebecca M. K. Tapscott

(57) ABSTRACT

A method for rewinding a web of sheet material for making a log wound on a core in a winding zone formed between an upper winding roller and a lower winding roller. Upstream of the winding zone a cradle is provided for feeding the core connected to the support of the lower roller and located beneath the upper winding roller. At least a portion of the cradle is movable with respect to the support of the lower roller and is capable of lowering or rising towards/away from the upper winding roller. For each step of feeding a core, the movable portion can be displaced from a first position of load of the core to a second position wherein the core contacts the upper roller. When the upper roller contacts the core for reaching the winding zone it moves first on the movable portion and then on a fixed portion of the cradle that is integral to the support wherein the axle rotates of the lower roller.

10 Claims, 7 Drawing Sheets

CORE FEEDING METHOD IN A REWINDING MACHINE FOR MAKING LOGS OF SHEET MATERIAL

This application claims priority to U.S. patent application Ser. No. 10/079,372, filed Feb. 19, 2002.

FIELD OF THE INVENTION

The present invention relates to a core feeding method in a rewinding machine for making logs of sheet or web material, for example used for the production of rolls of toilet paper, rolls of all purpose tissue paper for household use, non woven fabric, industrial rolls and the like.

Furthermore the invention relates to a rewinding machine that carries out this method.

DESCRIPTION OF THE PRIOR ART

Rewinding machines are known wherein a log is wound that is in contact surface with winding rollers. More precisely, the log is formed starting from a web of paper, continuous or with transversal perforations, which, carried by a first conveyor, is wound partially on an upper winding roller, enters into contact with a lower winding roller and is kept against the two upper and lower winding rollers by a pressure roller. The three rollers define a winding zone wherein the log is formed by feeding the web of paper and by dragging it for surface contact.

Normally, in the winding zone the log is formed on a tubular core. Once the log has reached a predetermined diameter, with a control normally on the paper length as wound, the web is cut or torn and the log is pushed away from the winding zone at the side opposite to the introduction zone of the core and, at the same time, a core is put in by a pusher.

Some rewinding machines, at the end of each winding step, provide a blade that cuts transversally the web against the upper winding roller, which has one or more cutting slots with which a retractable blade engages, mounted on an adjacent cutting roller.

In the case, instead, of rewinding machines with tearing system, the web is stopped upstream of or on the upper winding roller and the tearing is caused by the dragging action on the stopped web of the lower winding roller, on which the log is pushed by the pressure roller. Normally, a speed difference is created between said two rollers at the change of the log for causing the tearing.

Many methods exist for feeding the core into the winding zone. In a first case, a core at a time is fed on a loading tray and a pusher puts it into a winding zone. In this case, the pusher forces in a concentrated way against the core for forcing it between the winding rollers in presence of the paper, and it can get dented in the zone of contact, producing a faulty winding.

In a second case, the core is brought on a feeding cradle of curved shape located under the upper winding roller, whereby the friction against the upper roller brings it forward up to the contact with the lower winding roller for starting the winding. The cradle is formed by a series of curved guides that protrude rearwardly from the lower winding roller and are to it completely integral.

In presence of the feeding cradle, there is the advantage that a pad can be inserted between the core feeding point and the winding zone for tearing the paper. This way, the torn portion that is located upstream is caught automatically by the incoming core that is dragged by the upper roller against the cradle located underneath.

According to the size of the core, the lower roller is brought forward or away from the upper roller. However, a different cradle is necessary for each different diameter of the core. This causes stops in the production, an adjusting work and the need of a set of cradles, one for each different diameter of the core.

Other rewinding machines are known in the art, like those described in U.S. Pat. No. 5,769,352 or in U.S. Pat. No. 6,050,519.

In U.S. Pat. No. 5,769,352 a separate insertion device is provided to insert in the machine a core on which a web material is to be wound. The insertion device is arranged before a movable rolling surface and before a nip formed by an upper winding roller and a lower winding roller. The movable rolling surface forms, together with the upper winding roller a channel into which the core is inserted by the inserting device. A fixed portion of the rolling surface is provided integral to the support of the lower winding roller. The movable portion of the rolling surface rotates about a point of the inserting device. This causes a misalignments between the fixed portion and the movable portion.

In U.S. Pat. No. 6,050,519 the logs are wound with or without cores. This document provides a rolling surface between the upper and lower winding rollers that is integral to an arm that can rotate about the axis of lower winding roller. In the operation of the rewinding machine with cores, at the change of core diameter, the rolling surface must be changed. In fact, there is not a fixed portion of rolling surface that is integral to the axis of lower winding roller. The reason of moving the rolling surface is not related to changing the core size but to coreless winding.

SUMMARY OF THE INVENTION

It is an object of the present invention to provide a rewinding method for a web of paper for making logs, wherein the introduction of the core is carried out automatically on a cradle located beneath the upper winding roller, but wherein the change of the feeding cradle is not necessary according to the different diameter of the core.

It is another object of the present invention to provide a rewinding machine of a web of paper for making logs that is capable of carrying out this method.

It is a further object of the present invention to provide a rewinding machine in which the introduction of the core is carried out firmly for a variety of core diameters.

These and other objects are reached by the winding method of a web for making a log whose characteristic is that it comprises the steps of:

- feeding a web of paper in a winding zone formed between an upper winding roller and a lower winding roller;
- arranging upstream of the winding zone a core feeding cradle connected to the lower roller, the cradle being located beneath the upper winding roller and extending from a core feeding zone up to the lower winding roller;

Its characteristic being that at least a portion of the cradle is movable with respect to a point integral to the support of the lower roller and is capable of lowering or rising towards/away from the upper winding roller.

Preferably, for each feeding step of a core, the movable portion of the cradle can be displaced from a first position of load of the core to a second position wherein the core contacts the upper roller.

Advantageously, for reaching the winding zone and remaining in contact with the upper roller, the core moves on the movable portion of the cradle and then on a fixed portion of the cradle that is integral to the lower roller. Furthermore for reaching the winding zone remaining in contact with the upper roller, the core is pushed by the cradle against the upper roller in a resilient way.

In its movement of lowering/rising the movable portion rotates about a point integral to the support of said lower roller.

In a first embodiment, said point is a pivot concentric to the lower roller.

In an alternative embodiment, said point is a pivot belonging to said fixed portion. Preferably, the core is put on the cradle when the movable portion is in lowered position, rolling on a downhill portion of the movable portion up to reaching a peeping stop element.

In particular, the steps can be provided of:

rising the core by means of the movable portion up to an approached position to the upper roller without that there is contact with the latter, starting from the approached position further brief rising movement of the core until it is pushed against the upper winding roller, whereby the latter can bring it forward towards the winding zone.

If the web is not cut or torn upstream, the contact of the core same against the upper winding roller causes the tearing of the web along a line of transversal perforation that is located between the core and the winding zone. In this case a step is provided of stretching the web between the core and the winding zone.

According to another embodiment, a rewinding machine of a web for making a wound log on a core, in particular for the production of rolls of toilet paper, rolls of all purpose tissue paper or non woven fabric for household use, industrial rolls and the like, comprises:

means for feeding and dragging a web of paper;

a winding zone where a log is wound downstream of the means for feeding the web;

means for feeding the core;

a core feeding cradle arranged upstream of the winding zone, the cradle being located beneath the upper winding roller and extending between the means for feeding the core up to the lower winding roller;

Its characteristic being furthermore that it comprises means for lowering/rising the cradle with respect to the lower roller towards/away from the upper roller.

Preferably, the cradle has a resilient surface for adapting to the passage of the core pushing it against the upper roller. In particular, the cradle has a curved surface with concavity oriented towards the upper roller.

Advantageously, the means for lowering/rising the cradle towards/away from the upper winding roller are operatively connected to an arm pivoted to the same support wherein the axle of the lower winding roller rotates.

Preferably, the cradle has a fixed portion integral to the lower roller located downstream of the movable portion, the movable portion cooperating with the fixed portion in order to form a single surface of support for the core during winding. Starting from the edge of the means for feeding the movable portion may have a portion downhill and a peeping stop element.

Means are provided for controlling the means for lowering/rising selectively the movable cradle to a predetermined height with respect to the upper winding roller.

BRIEF DESCRIPTION OF THE DRAWINGS

Further characteristics and/or advantages of the rewinding method and of the rewinding apparatus according to the present invention will be made clearer with the following description of an embodiment thereof, exemplifying but not limitative, with reference to attached drawings wherein.

FIGS. from 2 to 5 show four different positions of the tail of the web of the wound log and of the head of the web of the log to be wound, as well as the steps of feeding the log in the core.

Figure 6:
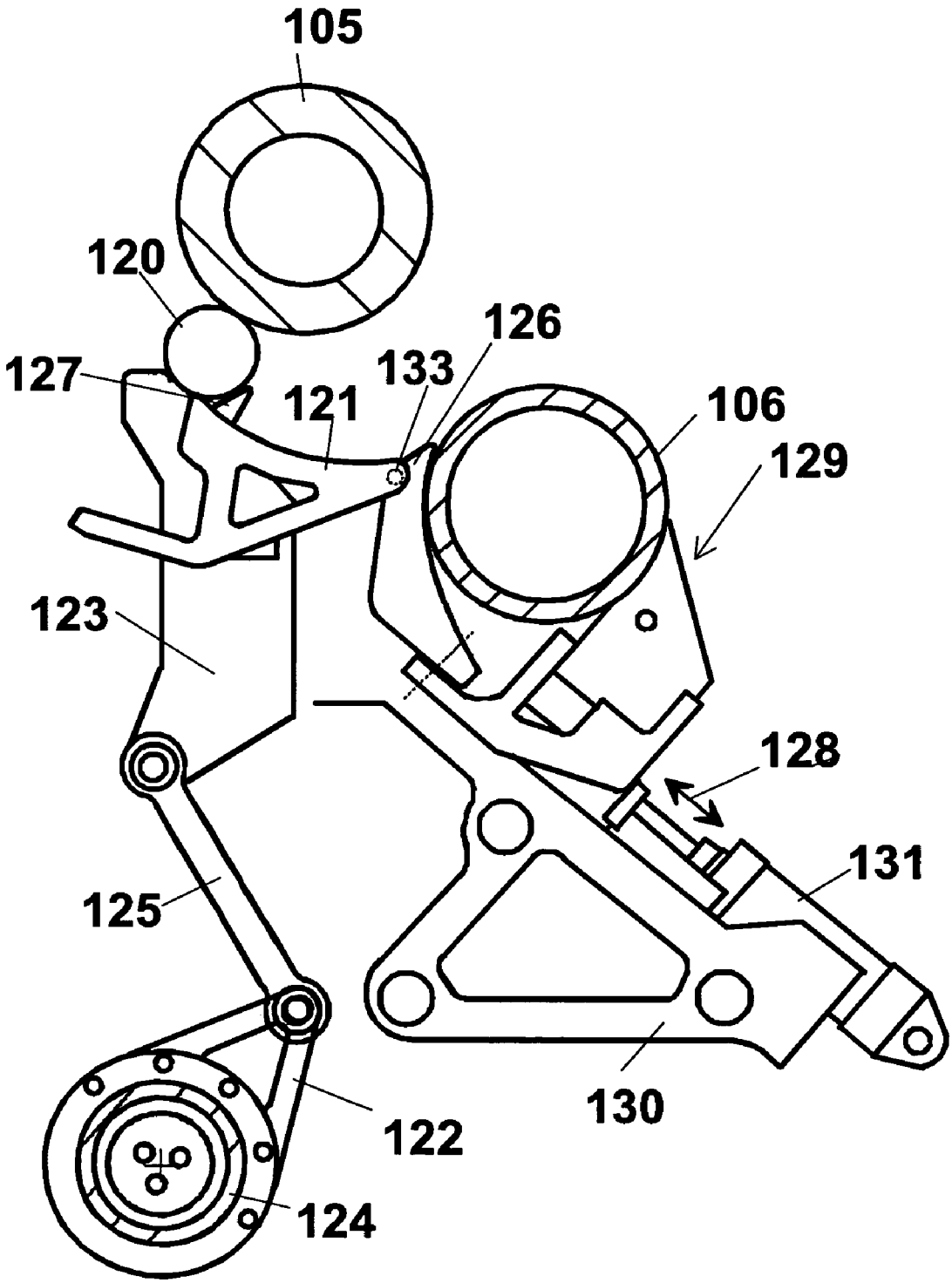
Figure 7:
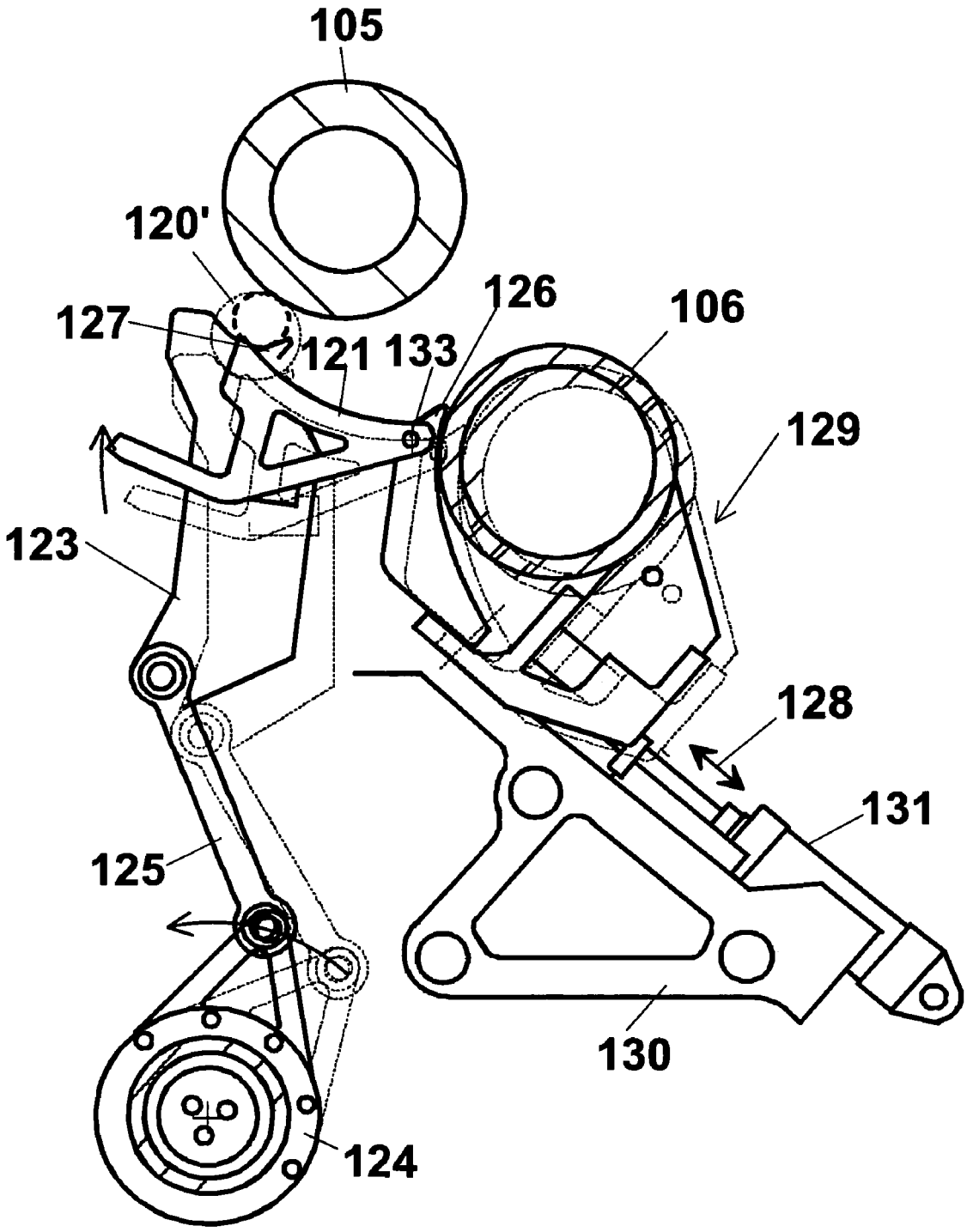

FIG. 6 shows a cross sectional view of an alternative embodiment of a rewinding machine according to the present invention perspective;

FIG. 7 shows the machine of FIG. 6 in case of rewinding a log on a core of smaller diameter.

DESCRIPTION OF A PREFERRED EMBODIMENT

Figure 1:
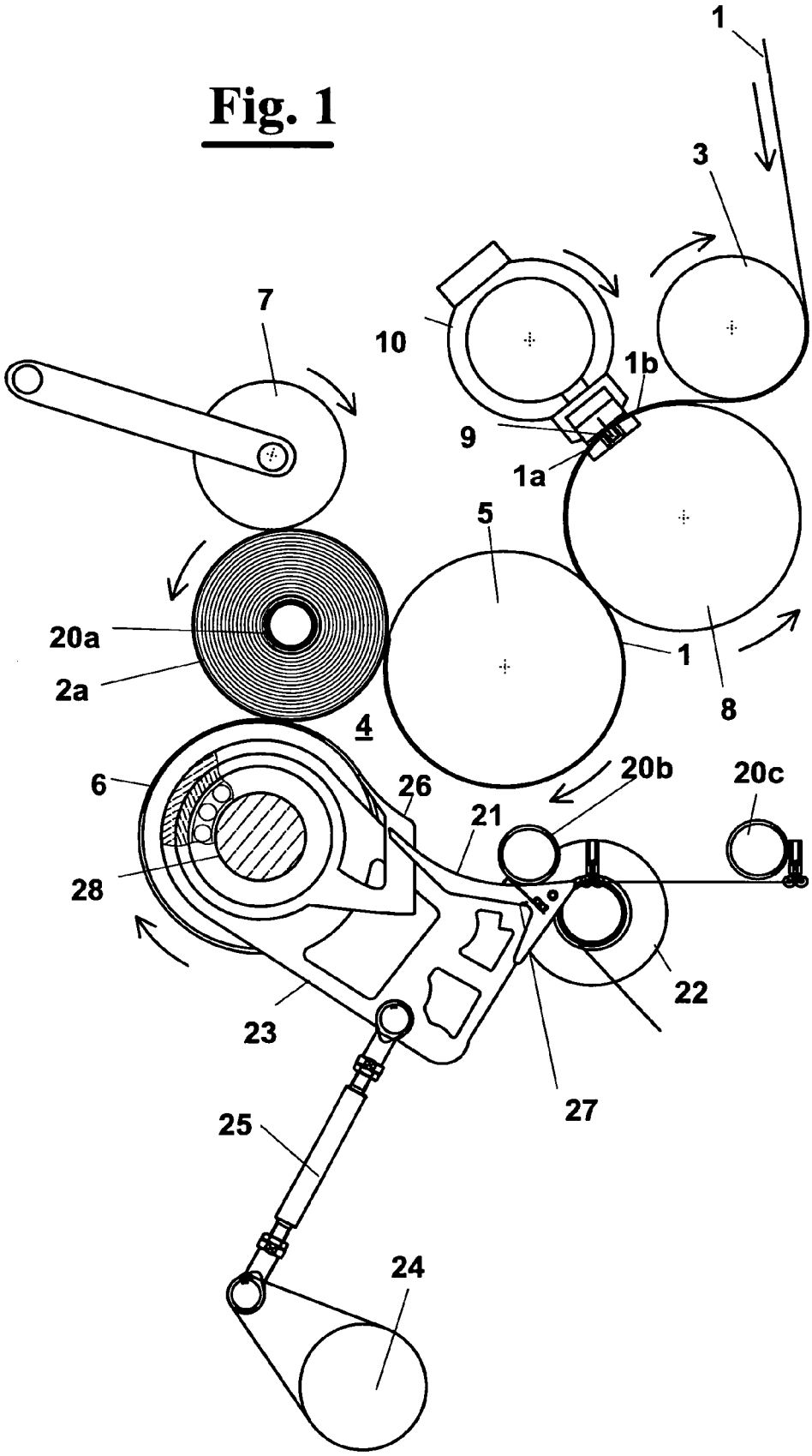
FIG. 1 shows a cross sectional view of a rewinding machine according to the present invention.

With reference to FIG. 1, a rewinding machine of a web 1 for making a log 2*a* comprises a roller 3 for feeding web 1 and, downstream of it, a winding zone 4 where the log 2*a* same is wound.

Winding zone 4, according to the prior art, is formed by an upper winding roller 5, a lower winding roller 6 and a pressure roller 7. The latter follows the growth of the log 2*a* with the task of assuring its continuous contact with the winding rollers 5 and 6 and of controlling the growth of its diameter.

Between feeding roller 3 and upper winding roller 5 a counter support roller 8 is provided on which web 1 rests. Counter support roller 8 can be driven independently and comprises a cutting means 10 that engage with a cutting slit 9. Alternatively, the cutting roller can operate directly on upper roller 5.

At the end of each log, blade 10 engages with countersupport roller 8 (or with upper roller 5) for cutting web 1, thus creating a tail end 1*a* of the previous log 2*a* and a head end 1*b* of a log to be formed.

Log 2*a*, which has bee already wound, continues to be brought into rotation in zone 4 for tangential friction against upper winding roller 5, lower winding roller 6 and pressure roller 7.

The winding step had started by a core 20*a*, which had been put into zone 4 by a chain conveyor 22. Furthermore a core 20*b* is ready for acting as a winding support for a log to be wound, starting from the head end 1*b* of web 1.

According to the invention, upstream of zone 4 a cradle is provided (21,26) for feeding a core 20*b*. Cradle (21,26) is located beneath upper winding roller 5 and extends between the chain conveyor 22 of the core up to lower winding roller 6. Movable cradle portion 21 is movable and is capable of lowering or rising towards/away from upper winding roller 5. At the end of movable portion 21, core 20*b* is brought by a fixed cradle portion 26, to which the terminal portion 21*a* of movable cradle portion 21 is adjacent.

More precisely, in its movement of lowering/rising movable cradle portion 21 rotates integrally to an arm 23 that is pivoted concentrically to lower roller 6. A driven shaft 24 by means of a connecting rod 25 is capable of operating the movement of lowering/rising arm 23 and then movable cradle portion 21.

Figure 2:
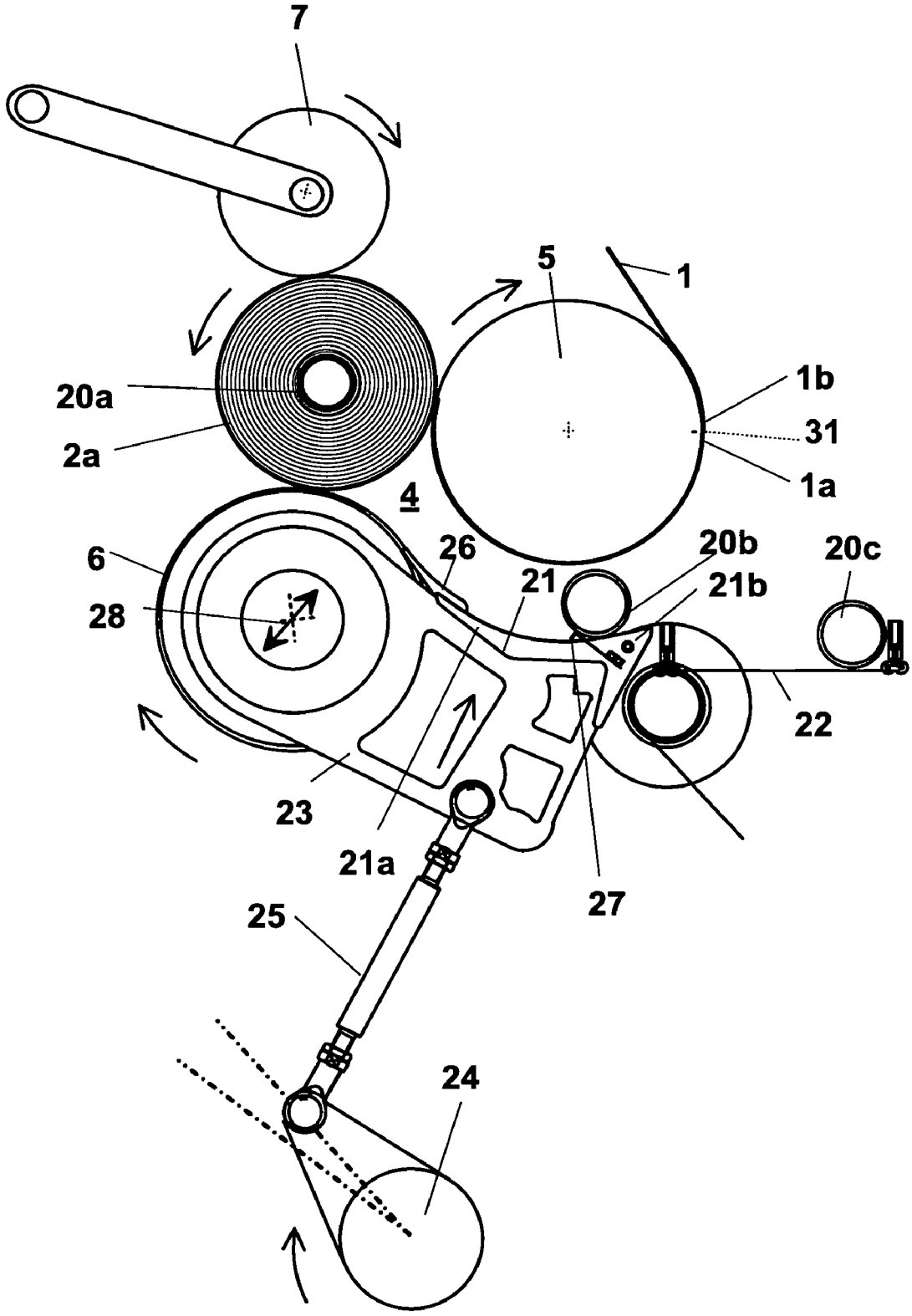

Always with reference to FIG. 1, core 20*b* is put on movable cradle portion 21 when it is in a lowered position, rolling on a downhill starting portion 21*b* up to a peeping stop 27. Then, as shown in FIG. 2, core 20*b* approaches upper roller 5 without contacting it.

Then, at the end of winding the previous log 2*a*, when the transversal perforation line 31 is located between core 20*b* and winding zone 4, with short and quick rising movement (FIG. 3) core 20*b* is brought by movable cradle portion 21 into contact with upper winding roller 5, which brings it quickly forward (FIG. 4), beyond peeping stop element 27 and towards lower winding roller 6.

Figure 3:
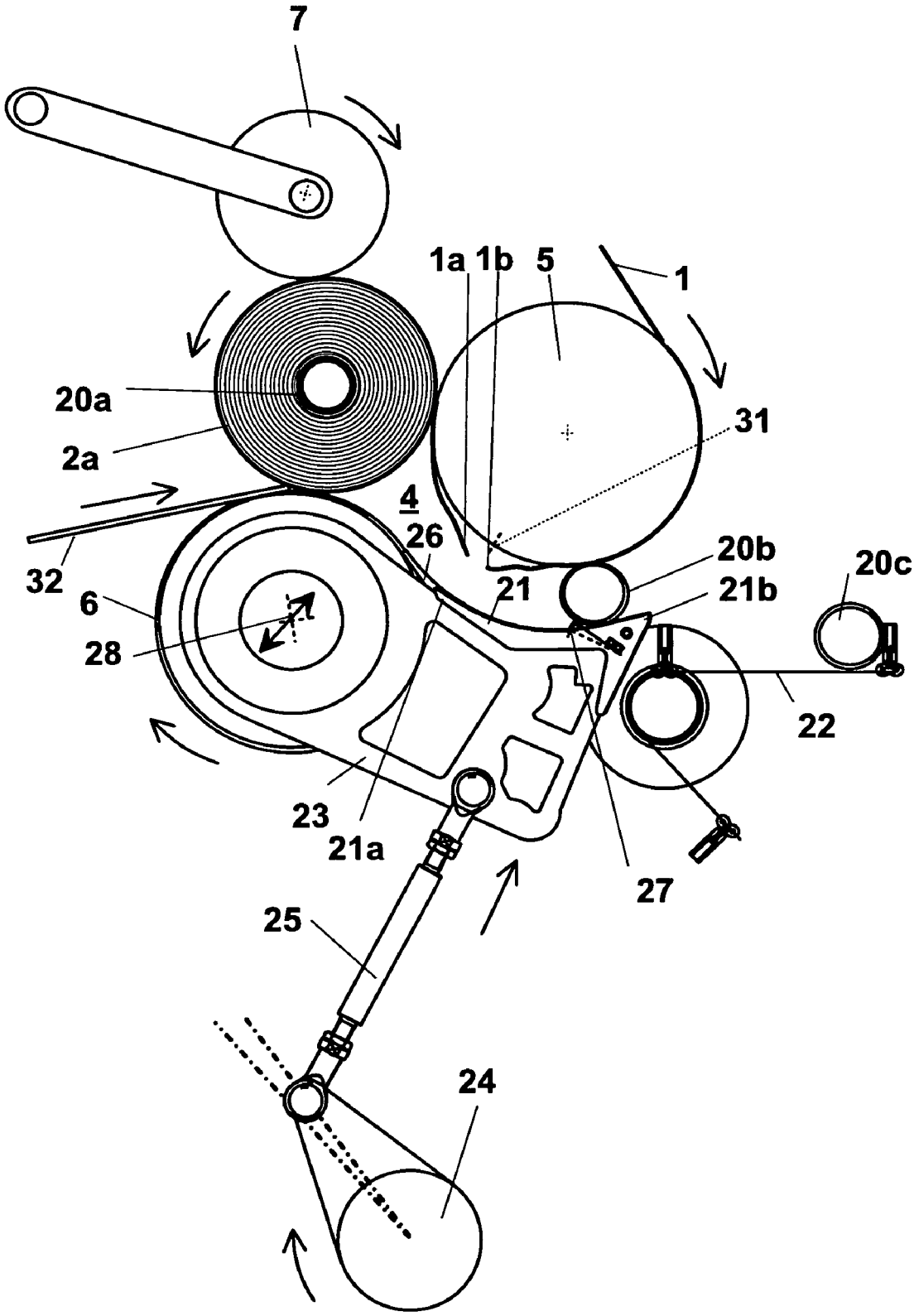

Peeping stop element 27 can be a harmonic steel blade, as that shown in the figure, or it can be a finger that is hinged to movable cradle portion 21 and yields by means of the action of a spring at the passage of the core (FIG. 3).

Figure 4:
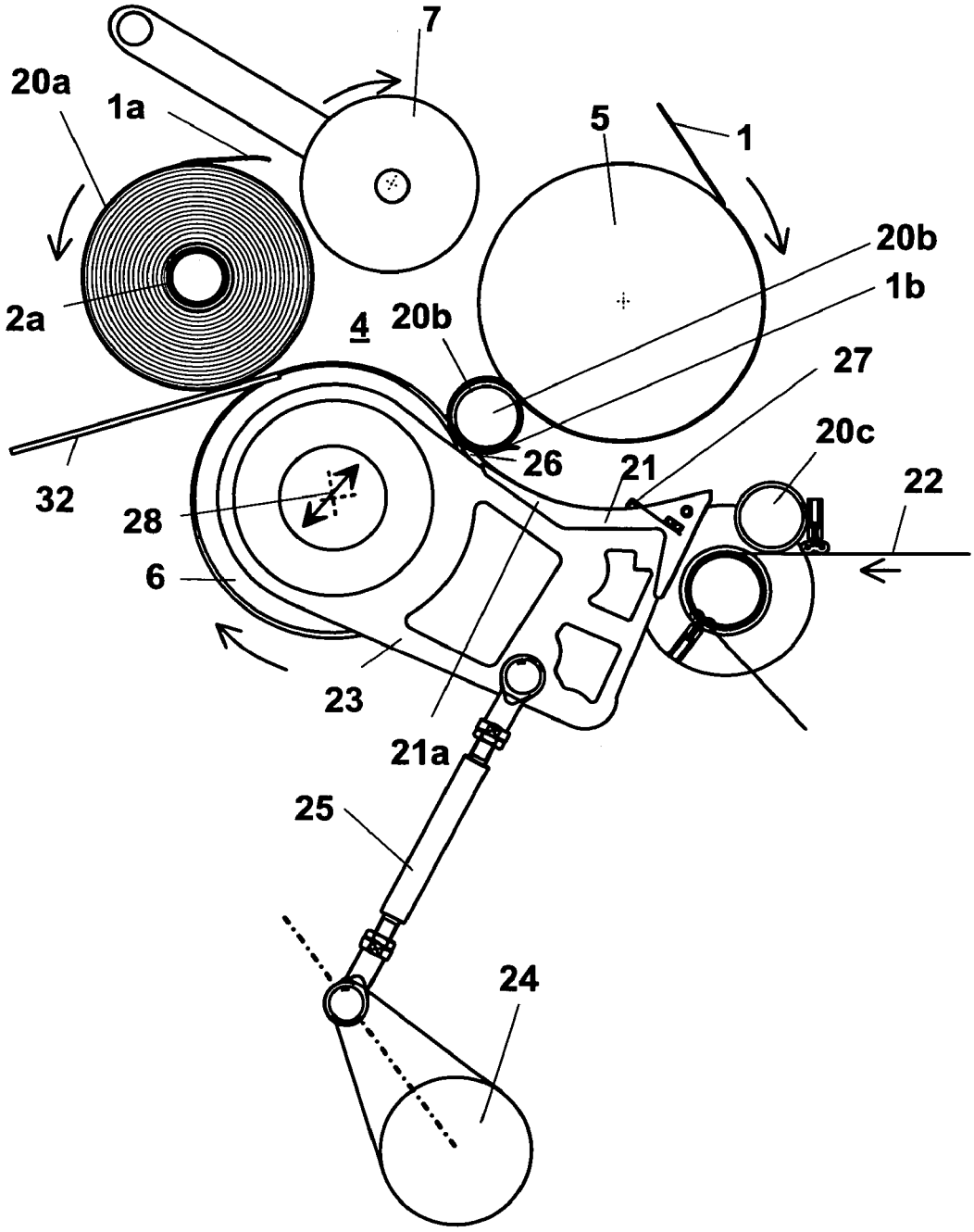

According to the prior art, core 20*b* is preglued along at least a line, whereby it quickly catches end 1*b* at the passage from the positions of FIGS. 3 and 4, moving on movable cradle portion 21.

Both movable cradle portion 21 and fixed cradle portion 26 have a curved surface with concavity oriented towards the upper roller. This surface, in a way not shown, may be resilient. For example it may have a surface coated of spongy material, or a plate suspended on springs, or a surface formed by a belt stretched between two ends.

Figure 5:
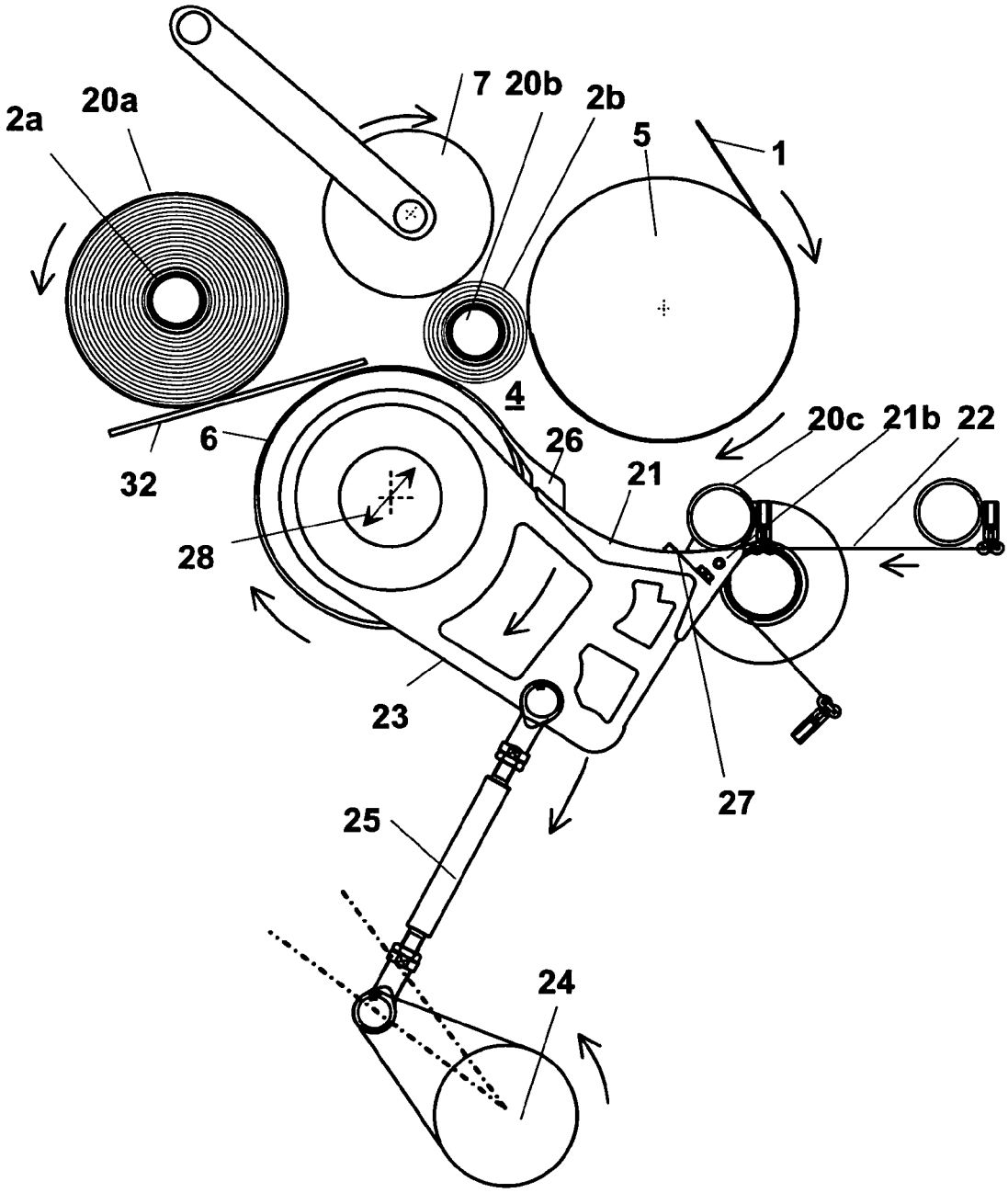

As shown in FIG. 5, core 20*b* reaches the winding zone 4 previously abandoned by log 2*a*. A log 2*b* starts to be wound for rotation of rollers 5, 6 and 7, as indicated by the relative arrows. A core 20*c* is put in by chain conveyor 22 after that the movable cradle portion 21 of the cradle, integrally to arm 23, has been lowered by connecting rod 25 by means of driven shaft 24. The new core 20*c* rolls on the short downhill portion 21*b* and reaches peeping stop element 27.

If the new core has not the same diameter as the previous one, it is necessary to adjust the machine for a new production campaign. More precisely, according to the different diameter of the core, lower roller 6, according to the prior art, is displaced in the direction of arrow, substantially in direction towards/away from the centre of lower roller 5. In this case, both fixed portion 26 and movable cradle portion 21, along with arm 23, follow integrally lower roller 6.

It is not, however, necessary to replace the cradle formed by cradle portions 21 and 26, since they have curved shape and movable cradle portion 21 is rotatable about support 28, in which the axle of lower roller 6 rotates, whereby when it presses onto core 20*b* (FIGS. 3 and 4) it assures in any case the presence of a rolling channel for the core, thus assuring that the core does not lose the contact with upper roller 5 or that it is too much squeezed. This aspect is particularly advantageous with respect to the machines that at the change of diameter of the core have fixed cradles necessarily changed.

As above said, the winding steps of web 1 for making a log 2*a* can provide the cut of the paper upstream of upper winding roller 5 (FIG. 1). In this case; the web of paper 1 is fed in the winding zone 4 about core 20*a* up to a predetermined development upstream of the feeding roller 3. Then, once the chosen length of web 1 upstream of zone 4 has been unwound, countersupport roller 8 at a cutting slit 9 with a transversal blade of cutting roller 10 cuts or tears web 1 separating the tail end 1*a* from head end 1*b*. From this moment the various steps are then successively carried out of bringing head end 1*b* towards the winding zone, not described in detail, but shown in EP1016608.

Alternatively, the contact of core 20*b* against upper winding roller 5 can cause the tearing of the paper 1 along a transversal perforation line 31 of the paper that is located between core 20*b* and winding zone 4. In this case a step is provided of stretching the web between the core and the winding zone. This stretching can be carried out by accelerating the abandonment movement of already wound log 2*a*, for example, according to the prior art, with interposition between already wound log 2*a* and the lower roller of a fixed tray 32 (FIG. 3, 4, 5), whereby log 2*a* runs quickly away on tray 32. Alternatively, always in a known way, the tearing step is carried out by acceleration of pressure roller 7 with respect to lower roller 6.

The preferred embodiment of the invention of FIGS. 1-5 has been shown only through a cross sectional view in five operative positions and not with a top plan view or an elevational view, that are not necessary since obvious for a man of the art. In such top plan or elevational views rollers 3, 8, 10, 5, 6 and 7 and driven shaft 24 would be seen that extend for all the maximum length of log 2*a* and of core 20*a*, with ends that engage with support walls by means of bearings as well as drive and transmission elements. Cradle (21,26) would be seen as a plurality of arms 23,26 arranged some centimetres from one another and connected to support 28 wherein the axle rotates of lower roller 6.

With reference to FIG. 6, another exemplary embodiment of a rewinding machine according to the invention comprises an upper winding roller 105, a lower winding roller 106 and a pressure roller not shown.

According to an embodiment of the invention, under upper winding roller 105 a cradle is provided (121, 126) for feeding a core 120. Cradle (121, 126) extends up to lower winding roller 106. A cradle portion 121 is movable and is capable of lowering or rising towards/away from upper winding roller 105. At the end of movable cradle portion 121, the core 120 is supported by a fixed cradle portion 126, to which movable cradle portion 121 is pivoted, at a point 133.

More precisely, in its movement of lowering/rising movable cradle portion 121 rotates integrally to an arm 123 about point 133. A driven shaft 124 by means of a crank 122 and a connecting rod 125 is capable of operating the movement of lowering/rising arm 123 and then of movable cradle portion 121.

Always with reference to FIG. 6, core 120 is put on movable cradle portion 121 when it is in a lowered position, rolling on a downhill starting portion of movable cradle portion 121 up to a peeping stop 127.

The operation is similar to that of FIGS. 2-5, and for this reason it is not necessary to repeat it in further detail.

As shown in FIG. 7, if a core 120' reaches the winding zone having a size substantially smaller than core 120, it is necessary to adjust the machine for a new production campaign. More precisely, according to the different diameter of the core, lower roller 106, according to the prior art, is displaced in the direction of arrow 128, by means of a cylinder/piston 131 that causes support 129 to slide on a fixed frame 130 substantially in a direction towards/away from the lower roller 106. In this case, both fixed cradle portion 126 and movable cradle portion 121, along with arm 123, follow integrally lower roller 106.

It is not, however, necessary to replace the cradle formed by cradle portions 121 and 126, since they have curved shape and movable cradle portion 121 is rotatable about point 133 which is integral to support 129, where the axle of lower roller 106 rotates.

The position of a pivot at point 133 of fixed cradle portion 126 about which movable cradle portion 121 rotates is important to reduce vibrations of movable cradle portion 121 in certain conditions, with respect to the case shown in FIGS. 1-5.

The exemplary embodiment of FIGS. 6 and 7 further improves the capability of adaptation of the cradle to the different sizes of the core, and its stability, without the need of changing the cradle with different ones.

The foregoing description of specific embodiments will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. A method for rewinding a web of sheet material for making a log wound on a core comprising the steps of:

feeding a web of paper in a winding zone formed between an upper winding roller and a lower winding roller, said lower roller having a support;

arranging upstream of the winding zone a cradle for feeding the core, wherein said cradle is located beneath the upper winding roller and extends from a core feeding zone up to said lower winding roller, and wherein a portion of said cradle is rotatable about a point integral to the support of said lower roller and is capable of lowering and rising towards and away from said upper winding roller, and wherein a portion of said cradle is fixed and integral to the support of the lower winding roller;

feeding a core in said core feeding zone of said cradle;

displacing said rotatable portion from a first position that allows feeding the core into the cradle to a second position in which said core is caused to contact said upper roller, wherein when the rotatable portion is in said second position, the rotatable portion and the fixed portion form a substantially continuous surface, wherein upon contacting said upper roller said core moves first over said portion of the cradle that is rotatable and then over said fixed portion of the cradle that is integral to the support of the lower winding roller, and wherein when a core of different diameter is fed in said core feeding zone, said portion of said cradle that is rotatable is caused to further rotate about said point in such a way that during said displacind step said core of different diameter is caused to contact said upper roller, whereby a change of the feeding cradle is not necessary according to the different diameter of the core.

2. The method according to claim 1, wherein said portion of said cradle that is rotatable rotates about a point concentric to said lower roller.

3. The method according to claim 1, wherein said portion of said cradle that is rotatable rotates about a point of said lower roller.

4. The method according to claim 1, wherein said said portion of said cradle that is rotatable rotates about a point on said fixed portion.

5. The method according to claim 1, wherein upon reaching said winding zone, while remaining in contact with said upper roller, said core is pushed by said cradle against said upper roller in a resilient way.

6. The method according to claim 1, wherein said core is put on said cradle when said at least one portion of the cradle is in a lowered position, rolling on a downhill portion of said at least one portion of the cradle up to reaching a peeping stop element.

7. The method according to claim 1, further includeing the steps of: raising said core by means of said at least one portion of the cradle up to a position substantially adjacent to, but not in contact with, said upper winding roller; and starting from said substantially adjacent position, raising and pushing said core against said upper winding roller, whereby said upper winding roller can bring said core forward towards the winding zone.

8. The method according to claim 1, wherein contact of the core against the upper winding roller allows tearing of the web along a transversal perforation line located between the core and the winding zone.

9. The method according to claim 8 further including stretching said web between said core and said winding zone before tearing said web alone said transversal perforation line.

10. The method according to claim 1, wherein said sheet material is selected from a group consisting of toilet paper, all-purpose tissue paper, and non-woven fabric.

* * * * *